US006314877B1

(12) United States Patent
Takasawa

(10) Patent No.: US 6,314,877 B1
(45) Date of Patent: Nov. 13, 2001

(54) PRINTER

(75) Inventor: Hironobu Takasawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/604,575

(22) Filed: Jun. 27, 2000

(30) Foreign Application Priority Data

Jun. 29, 1999 (JP) ..... 11-183196

(51) Int. Cl.[7] ..... B41L 13/04
(52) U.S. Cl. ..... 101/116; 101/115; 101/119
(58) Field of Search ..... 101/116, 115, 101/485, 114, 117, 118, 119, 129, 181, 216, 247, 248, 211

(56) References Cited

U.S. PATENT DOCUMENTS 3,847,079 * 11/1974 Dahlgren ..... 101/216
5,375,516 * 12/1994 Hasegawa ..... 101/116
5,454,308 * 10/1995 Sato et al. ..... 101/116
5,570,633 * 11/1996 Schultz et al. ..... 101/247
5,713,275 * 2/1998 Imai ..... 101/119
5,931,010 * 8/1999 Ohkawa ..... 101/118
6,041,705 * 3/2000 Lintner ..... 101/116
6,076,458 * 6/2000 Ohno ..... 101/119
6,098,536 * 8/2000 Ohkawa ..... 101/118
6,109,176 * 8/2000 Fujio et al. ..... 101/216
6,155,169 * 12/2000 Kacmarcik et al. ..... 101/211
6,205,918 * 3/2001 Takahashi et al. ..... 101/118

* cited by examiner

*Primary Examiner*—Eugene Eickholt
(74) *Attorney, Agent, or Firm*—Oblon, Spivak, McClelland, Maier & Neustadt, P.C.

(57) ABSTRACT

In a printer including a plurality of print drums sequentially arranged in a direction of sheet conveyance, a member causative of noticeable variation in load during printing is driven by a driveline assigned to one print drum that is connected to a main drive source. The printer reduces synchronization errors between the print drums ascribable to variation in load and therefore reduces offset ghosts while making the most of the advantages of a timing belt type drive system.

8 Claims, 13 Drawing Sheets

[SPEED VARIATION AT DRUM 1 SIDE]

| | |
|---|---|
| DRUM 1 | × |
| DRUM 2 | × |
| AIR PUMP 1′ | ○ |
| AIR PUMP 2′ | × |

[SPEED VARIATION AT DRUM 1 SIDE]

| | |
|---|---|
| DRUM 1 | × |
| DRUM 2 | × |
| AIR PUMP 1′ | × |
| AIR PUMP 2′ | ○ |

[SPEED VARIATION AT DRUM 1 SIDE]

| | |
|---|---|
| DRUM 1 | × |
| DRUM 2 | ○ |
| AIR PUMP 1′ | × |
| AIR PUMP 2′ | ○ |

(SPEED VARIATION AT DRUM 2 SIDE)

| | |
|---|---|
| DRUM 1 | ○ |
| DRUM 2 | ○ |
| AIR PUMP 1′ | × |
| AIR PUMP 2′ | × |

(SPEED VARIATION AT DRUM 1 SIDE)

| | |
|---|---|
| DRUM 1 | ○ |
| DRUM 2 | ○ |
| AIR PUMP 1′ | × |
| AIR PUMP 2′ | × |

[SPEED VARIATION AT DRUM 1 SIDE]

| | |
|---|---|
| DRUM 1 | ○ |
| DRUM 2 | ○ |
| AIR PUMP 1′ | ○ |
| AIR PUMP 2′ | ○ |

[SPEED VARIATION AT DRUM 1 SIDE]

| | |
|---|---|
| DRUM 1 | ○ |
| DRUM 2 | ○ |
| AIR PUMP 1′ | ○ |
| AIR PUMP 2′ | ○ |

PRINTER

BACKGROUND OF THE INVENTION

The present invention relates to a stencil printer or similar printer and more particularly to a printer including a plurality of spaced print drums for producing a color print by passing a paper sheet only once.

A color stencil printer, for example, includes a plurality of print drums sequentially arranged at preselected intervals in a direction in which a paper sheet is conveyed. While a paper sheet is conveyed in the above direction, the upstream print drum to the downstream print drum, in the above direction, each transfer an ink image of particular color to the paper sheet. As a result, ink images of different colors are transferred to the paper sheet one above the other. The printer can therefore produce a color print by passing the paper sheet only once. Such a single-pass system is far more efficient than a system that requires a print drum to be replaced color by color and repeatedly feeds the same paper sheet. The single-pass system, however, has some problems left unsolved due to a short interval between consecutive printing positions, as will be described hereinafter.

An image transferred from an upstream drum assigned to, e.g., a first color to a paper sheet arrives at a downstream print drum assigned to, e.g., a second color before ink forming the image dries. As a result, the ink is transferred to a master or cut stencil wrapped around the downstream print drum and then transferred from the master to the next paper sheet. As for the first paper sheet, the wet ink of the first color is simply transferred to the mater existing on the print drum of the second color and does not matter at all. However, the ink of the first color is again transferred from the master to the second paper sheet carrying an image of the first color transferred from the print drum of the first color (generally referred to as retransfer).

Retransfer superposes ink of the same color and therefore does not degrade image quality so long as the image transferred from the master to the second paper sheet is in accurate register with the image existing on the second paper sheet. However, if the retransferred image is shifted from the image existing on the paper sheet, it produces a shadow or so-called offset ghost. For a given amount of shift, the offset ghost renders a thick line blurred and renders a thin line double, thereby degrading image quality to a critical degree.

While retransfer is not avoidable in the single-pass color printing system, an offset ghost ascribable to positional shift can be accurately reduced if the upstream and downstream drums are accurately synchronized to each other during rotation and if a paper sheet is accurately conveyed. Stated another way, should the print drums fail to rotate in synchronism with each other, an offset ghost repeatedly occur.

To reduce offset ghosts, it has been customary to interlock the upstream and downstream print drums with respect to drive. Japanese Patent Laid-Open Publication No. 4-329175, for example, discloses an arrangement wherein the shafts of print drums are connected by gears. Japanese Patent Laid-Open Publication No. 7-17121 teaches an arrangement wherein the shafts of print drums are connected by a timing belt. With the gear scheme, it is possible to reduce the amount of an offset ghost by increasing the precision of the gears. High precision gears, however, increase the production cost of the printer. By contrast, the timing belt scheme successfully reduces the production cost because use can be made of timing pulleys and other inexpensive members that can be produced by, e.g., injection molding on a quantity basis. This kind of scheme, however, increases the amount of an offset ghost more than the gear scheme.

Technologies relating to the present invention are also disclosed in, e.g., U.S. patent application Ser. Nos. 09/079,287, 09/164,372, 09/274,324 now U.S. Pat. No. 6,205,918 and 09/532,055.

SUMMARY OF THE INVENTION

It is therefore an object of the present invention to provide a printer capable of accurately reducing an offset ghost while using the timing belt scheme that is low cost.

In accordance with the present invention, in a printer including a plurality of print drums arranged at a preselected interval in a direction in which a paper sheet is conveyed, and a timing belt interlocking the plurality of print drums with respect to drive, a driveline assigned to one print drum and including a main drive source concentratedly drives a member causative of noticeable variation in load during printing without regard to a positional relation between the above member and the one print drum.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, brief reference will be made to a conventional bicolor stencil printer taught in Japanese Patent Laid-Open Publication No. 7-17121 mentioned earlier, shown in FIG. 1. The printer to be described includes two print drums interlocked to each other by a timing belt with respect to drive in order to solve the previously discussed problems.

Figure 1:
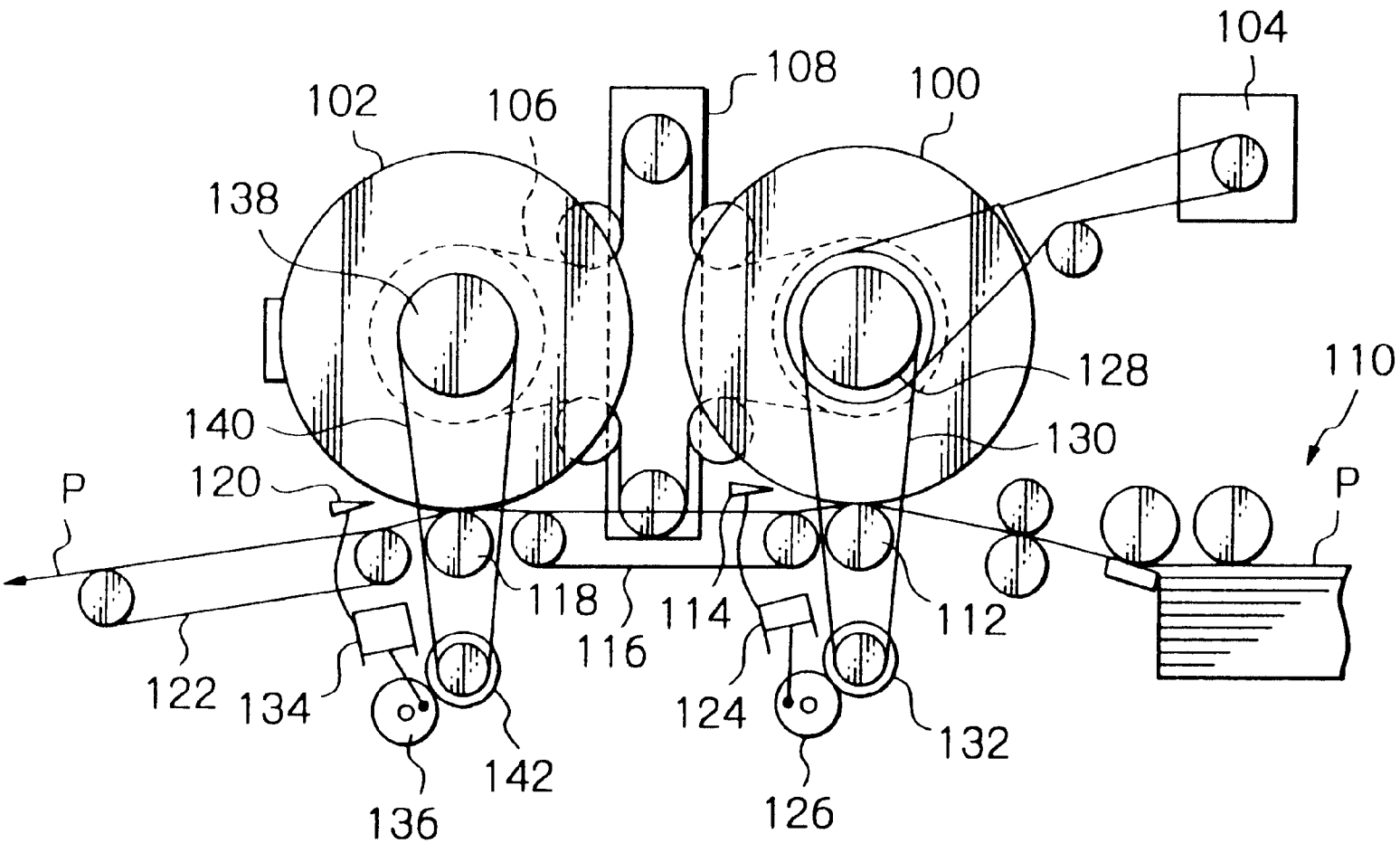
Fig. 1 PRIOR ART
FIG. 1 is a front view showing the general construction of a conventional printer using the timing belt scheme.

As shown in FIG. 1, the printer includes an upstream print drum 100 and a downstream print drum 102 spaced from each other in a direction in which a paper sheet P is conveyed. The print drums 100 and 102 are assigned to a first color and a second color, respectively. A main motor 104 causes the print drum 100 to rotate. A timing belt 106 is passed over the print drums 100 and 102 so as to transfer the rotation of the print drum 100 to the print drum 102. The print drum 102 is therefore rotated in synchronism with the print drum 100. Drum phase adjusting means 108 is interposed between the print drums 100 and 102 and movable in the up-and-down direction.

A press roller 112 presses the paper sheet P fed from paper feeder 110 against the print drum 100 so as to transfer an ink image of a first color to the paper sheet P. An air jet type peeler 114 peels off the paper sheet P carrying the ink image thereon from the print drum 100 and thereby prevents it from rolling up together with the print drum 100. Intermediate conveying means 116 conveys the paper sheet P separated from the print drum 100 to another press roller 118.

The press roller 118 presses the paper sheet P against the print drum 102 in order to transfer an ink image of a second color to the paper sheet P over the image of the first color. Another air jet type peeler 120 peels off the paper sheet P carrying the resulting bicolor image from the print drum 102. Outlet conveying means 122 conveys the paper sheet P separated from the print drum 102 to a tray not shown.

Air pumps or air sources 124 and 134 are assigned to the peelers 114 and 120, respectively. The air pump 124 is driven by a rotary shaft 126 that is, in turn, driven by a rotary shaft 132. The print drum 100 includes a rotary shaft 128 whose rotation is transferred to the shaft 132 by a belt 130. Likewise, the air pump 134 is driven by a rotary shaft 136 that is, in turn driven by a rotary shaft 142. The print drum 102 includes a rotary shaft 138 whose rotation is transferred to the shaft 142 by a belt 140.

The conventional timing belt scheme, however, aggravates the offset ghost problem more than the gear scheme, as stated earlier.

In the construction shown in FIG. 1, the air pumps 124 and 134 assigned to the peelers 114 and 120, respectively, each need a great torque during compression, but need only a small torque during suction. That is, noticeable changes in load occur during printing. On the other hand, the air pumps 124 and 134 are indirectly driven by the shaft 128 of the print drum 100 and the shaft 138 of the print drum 102, respectively.

I presumed that the noticeable changes in the loads acting on, e.g., the air pumps 124 and 134 and the independent drivelines extending from the print drums 100 and 102, which are connected together by the timing belt 106, to the pumps 124 and 134 aggravated the offset ghost. More specifically, I estimated that the above changes in load aggravated changes in the relative speed between the print drums 100 and 102. A series of experiments, which will be described later, proved that the changes in the loads acting on the air pumps 124 and 134 aggravated changes in the relative speed between the print drums 100 and 102. The present invention is a drastic solution to this problem.

Figure 2:
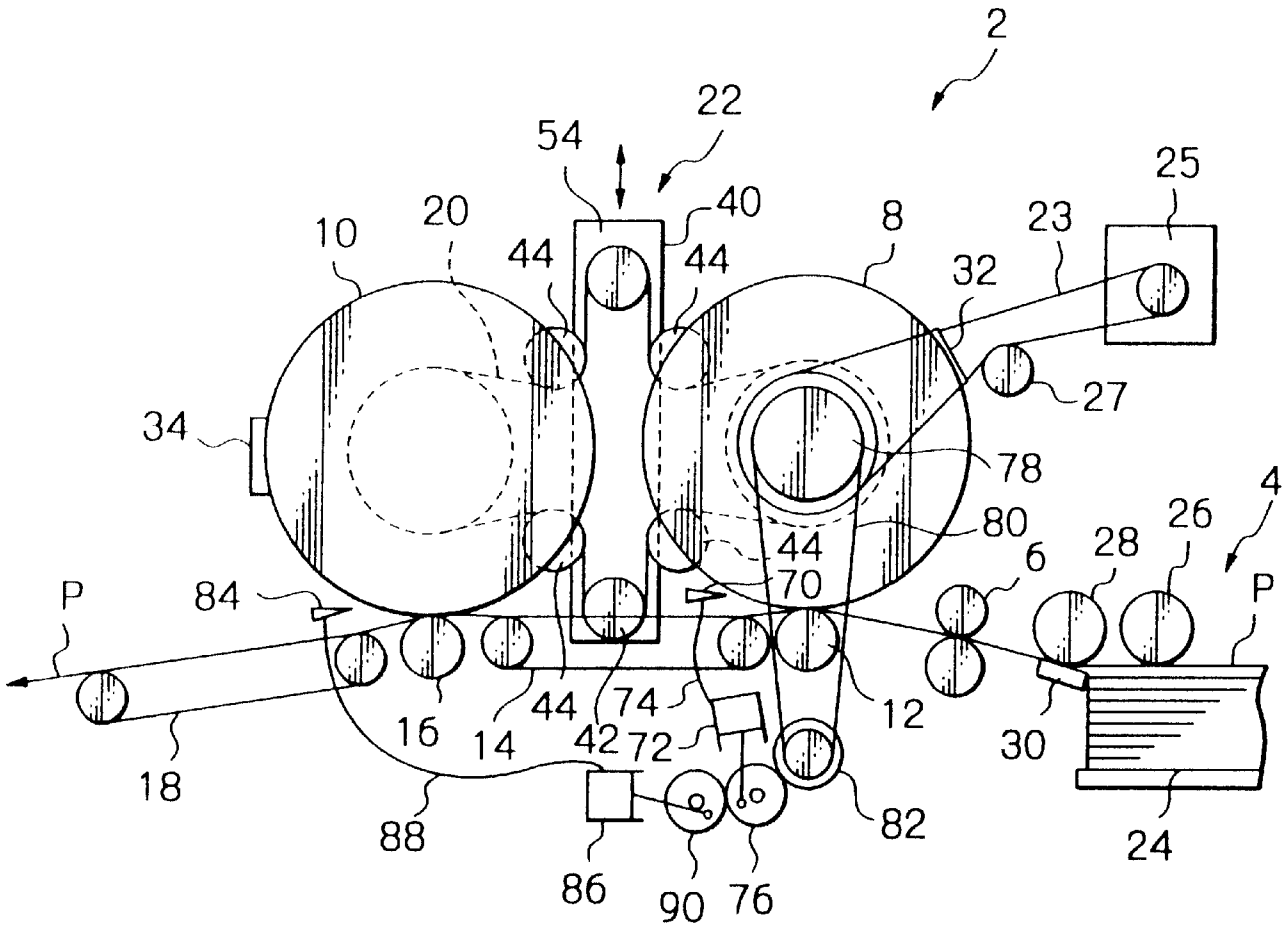
FIG. 2 is a front view showing a printer embodying the present invention.

Referring to FIG. 2, a printer embodying the present invention is shown and implemented as a bicolor stencil printer 2 by way of example. As shown, the printer, generally 2, includes paper feeding means 4 loaded with a stack of paper sheets P and a registration roller pair 6. Two print drums 8 and 10 are spaced from each other in a direction in which the paper sheets P are sequentially fed form the paper feeding means 4. A press roller 12 is movable into and out of contact with the print drum 8, which is located at the upstream side in the above direction of paper feed, by being driven by moving means not shown.

Intermediate conveying means 14 conveys the paper sheet P from the print drum 8 to the print drum 10 that is located at the downstream side. A press roller 16 is movable into and out of contact with the print drum 10 by being driven by moving mechanism not shown. Outlet conveying means 18 conveys the paper sheet P separated from the print drum 10 to a tray not shown. The print drums 8 and 10 are interlocked to each other by a timing belt 20 with respect to drive. Drum phase adjusting means 22 intervenes between the print drums 8 and 10 for adjusting a relative phase between the print drums 8 and 10.

A main drive motor or main drive source 25 causes the print drum 8 to rotate via a main drive belt 23. A timing belt 20 transfers the rotation of the print drum 8 to the other print drum 10. The main drive belt 23 is held under preselected tension by a pulley 27.

The paper feeding means 4 includes a paper tray 24 on which the paper sheets P are stacked. A motor, not shown, causes the paper tray 24 to intermittently move upward. A pickup roller 26, a separator roller 26 and a separator pad 30 cooperate to pay out the top paper sheet P from the tray 24 toward the registration roller pair 6 while separating it from the underlying paper sheets P.

The registration roller pair 6 corrects, e.g., the skew of the paper sheet P and then drives it toward the print drum 8 such that the leading edge of the paper sheet P meets the leading edge of an image existing on the print drum 8. The press drum 12 is pressed against the print drum 8 in synchronism with the movement of the paper sheet P. Ink feeding means is positioned inside of the print drum 8 for feeding ink of a first color to the print drum 8. When the press roller 12 presses the paper sheet P against the print drum 8, the ink of the first color is transferred to the paper sheet P via perforations formed in a master or cut stencil that is wrapped around the drum 8. As a result, an image of a first color is formed on the paper sheet P. The press roller 12 is intermittently pressed against the print drum 8 so as not to interfere with a master clamper 32 mounted on the print drum 8.

A peeler 70 peels off the paper sheet P carrying the image of the first color thereon from the print drum 8. In the illustrative embodiment, the peeler 70 is fluidly communicated to an air pump 72 by a tubing 74 and jets compressed air toward the interstice between the print drum 8 and the leading edge of the paper sheet P at a preselected timing. The compressed air separates the paper sheet P from the print drum 8 by a non-contact system. This prevents the paper sheet P from rolling up together with the print drum 8 due to the adhering force of the ink.

A rotary shaft 76 causes the air pump 72 to compress air. A rotary shaft 82 causes the shaft 76 to rotate. The print drum 8 includes a rotary shaft 78 drivably connected to the shaft 82 by a belt 80.

The intermediate conveying means 14 conveys the paper sheet P separated from the print drum 8 to a nip between the print drum 10 and the press roller 16. In the illustrative embodiment, the intermediate conveying means 14 includes a fan, not shown, so as to convey the paper sheet P while retaining it thereon by suction. The intermediate conveying means 14 moves at a linear velocity a preselected number of times higher than the linear velocity of the paper sheet P.

When the paper sheet P arrives at the nip between the print drum 10 and the press roller 16, the press roller 16 presses the paper sheet P against the print drum 10. Ink feeding means is also positioned inside of the print drum 10 for feeding ink of a second color to the print drum 10. As a result, the ink of the second color is transferred to the paper sheet P via perforations formed in a master or cut stencil that is wrapped around the drum 10, forming an image of a second color over the image of the first color. The press roller 16 is intermittently pressed against the print drum 10 so as not to interfere with a master clamper 34 mounted on the print drum 8.

A peeler 84 peels off the paper sheet P carrying the bicolor image thereon from the print drum 10. In the illustrative embodiment, the peeler 84 is also fluidly communicated to an air pump 86 by a tubing 88 and jets compressed air toward the interstice between the print drum 10 and the leading edge of the paper sheet P at a preselected timing. Again, the compressed air separates the paper sheet P from the print drum 10 by a non-contact system so as to prevent the paper sheet P from rolling up.

The air pump 86 is driven by a rotary shaft 90 which is, in turn, rotated by the previously mentioned rotary shaft 76 associated with the print drum 8. The shafts 76 and 90 are connected by gears with a preselected phase difference from each other. Specifically, the air pumps 72 and 86, which are members causative of noticeable changes in load during printing, both are driven by the upstream print drum 8 in the direction of paper conveyance. The top dead center of the air pump 72 and that of the air pump 86 are shifted from each other by a phase difference between the print drums 8 and 10. Stated another way, arrangements for driving the members causative of noticeable changes in load during printing concentrate on the upstream side. Advantages achievable with such arrangements will be described specifically later.

The outlet conveying means 18 conveys the paper sheet P separated from the print drum 10 to a tray not shown. In the illustrative embodiment, the outlet conveying means 18 also includes a fan, not shown, so as to convey the paper sheet P while retaining it thereon by suction.

Figure 3:
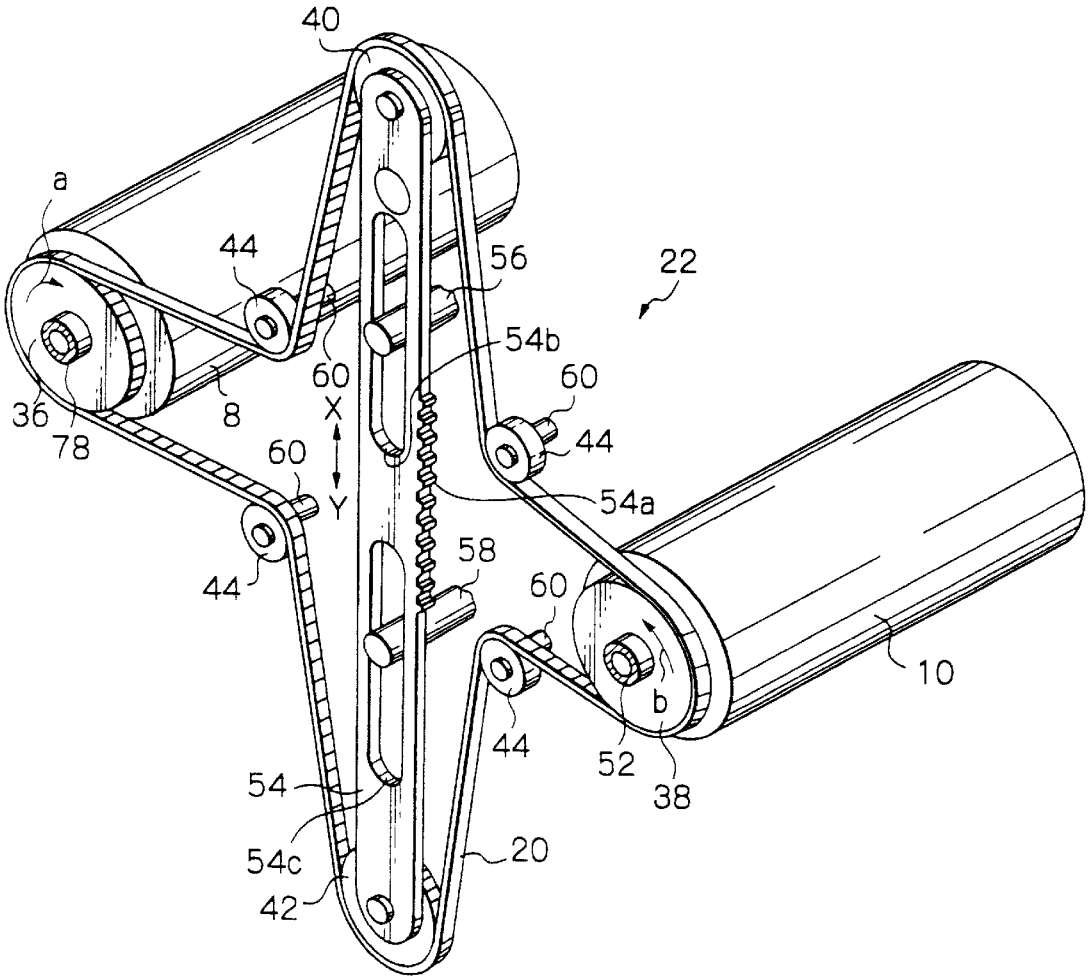
FIG. 3 is an isometric view of drum phase adjusting means included in the illustrative embodiment.

As shown in FIG. 3, the print drum 10 includes a rotary shaft 52 while the print drum 8 has the previously mentioned rotary shaft 78. Toothed drum drive pulleys or timing pulleys 36 and 38 are respectively mounted on the shafts 78 and 52 such that the print drums 8 and 10 are replaceable. The drum drive pulleys 36 and 38 are positioned at the rear side as seen in FIG. 3 or at the front side as seen in FIG. 2. A timing belt 20 is passed over the drum drive pulleys 36 and 38.

The drum phase adjusting means 22 includes two adjusting pulleys or timing pulleys 40 and 42. Four steering pulleys 44 are arranged between the adjusting pulleys 40 and 42 and drum drive pulleys 36 and 38, as illustrated. The steering pulleys 44 allow the drum phase adjusting means 22 to efficiently adjust the relative phase between the print drums 8 and 10 by a minimum of displacement in the up-and-down direction. The steering pulleys 44 play the role of tension pulleys at the same time.

More specifically, as best shown in FIG. 3, the drum phase adjusting means 22 includes a frame extending in the up-and-down direction. The adjusting pulleys 40 and 42 are rotatably mounted on the upper and lower ends of the frame 54, respectively. A pinion, not shown, is held in mesh with a rack portion 54*a* included in the frame 54. A motor, not shown, causes the pinion meshing with the rack portion 54*a* to rotate. An upper and a lower elongate slot 54*b* and 54*c* are respectively formed in an upper and a lower portion of the frame 54, and each extends in the up-and-down direction. Guide pins 56 and 58 are studded on opposite sidewalls, not shown, and received in the slots 54*b* and 54*c*, respectively. The frame 54 is movable upward or downward, as needed, while being guided by the guide pins 56 and 58 and guide members, not shown, affixed to the opposite side walls.

The steering pulleys 44 are implemented as spur pulleys, and each is rotatably supported by a respective shaft 60 affixed to the opposite sidewalls. The steering pulleys 44 are held in contact with the timing belt 20 in such a manner as to squeeze the timing belt 20 inward.

When the pinion is so rotated as to move the frame 54 upward, as indicated by an arrow X in FIG. 3, the frame 54 raises the adjusting pulleys 40 and 42 and thereby causes the print drums 8 and 10 to rotate in directions indicated by arrows a and b, respectively. As a result, the relative phase between the print drums 8 and 10 varies in order to correct a shift between the colors. The pinion may be so rotated as to lower the frame 54, as indicated by an arrow Y in FIG. 3, in which case the relative phase between the print drums 8 and 10 will vary in the opposite direction.

I conducted a series of experiments for determining whether or not the load of the downstream print drum added to the upper print drum caused the rotation speed of the upper print drum to vary. It is to be noted that the reference numerals to appear hereinafter were attached to experimental print drums and air pumps. While the rotation speed of an upper print drum 1 was measured by adding the load of a downstream print drum 2 to the drum 1, the experiments were conducted in a free-run condition because the drum 1 could not effect printing alone. That is, experiments with a sheet feed pressure and a print pressure, which were loads to act during printing, were not conducted.

In an experimental arrangement, air pumps 1' and 2' were respectively driven by the shafts of the print drums 1 and 2, as in the conventional arrangement. In addition, an encoder (1,800 pulses) is mounted on each of the shafts of the print drums 1 and 2. Such encoders each were connected to an oscilloscope via a respective F/V (Frequency/Voltage) converter. A waveform appearing on the oscilloscope was printed out.

Figure 4:
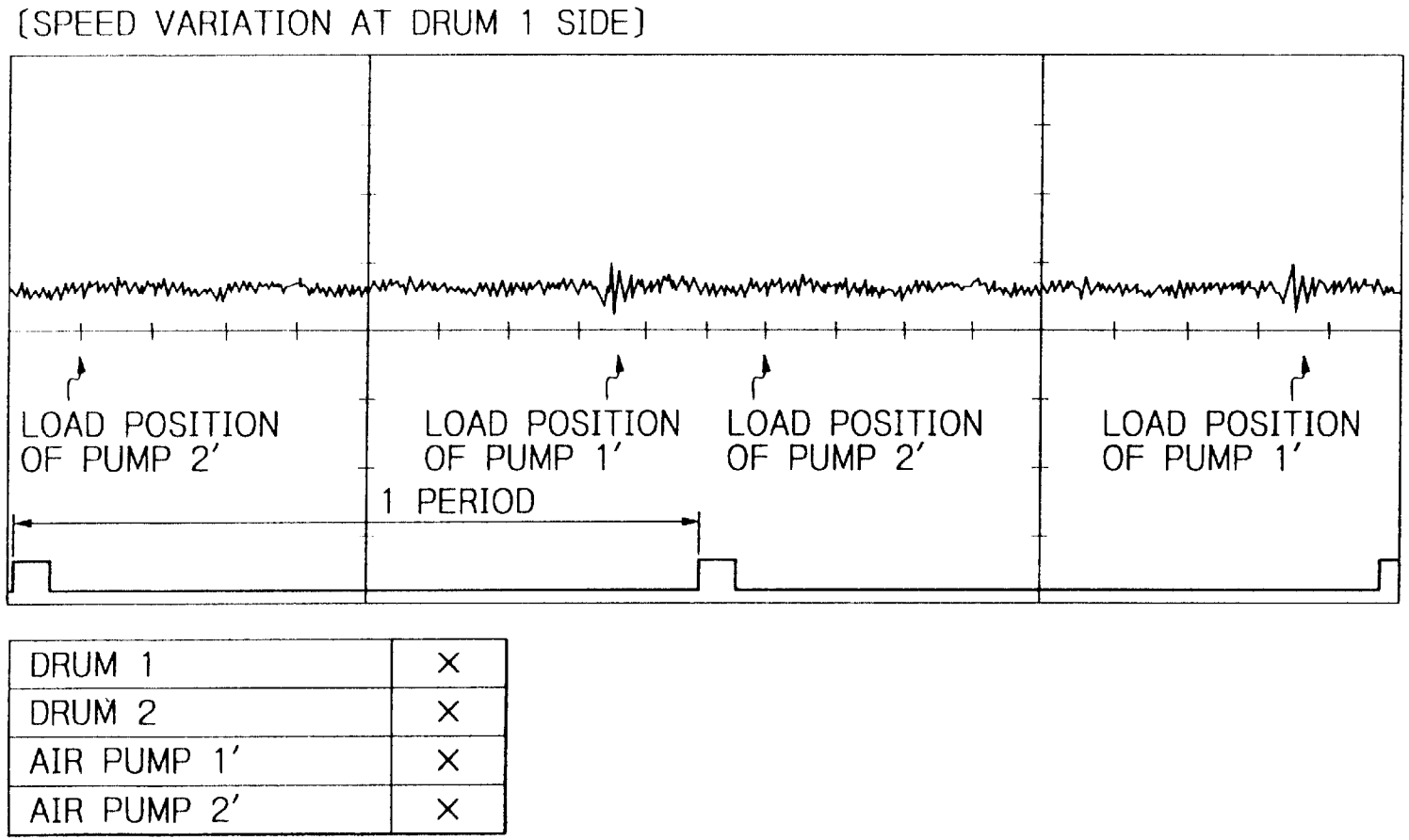
FIG. 4 shows a waveform representative of variation in the rotation speed of an upstream print drum occurred when air pumps were absent.

FIG. 4 shows a waveform representative of the speed variation of the print drum 1 and appeared over two periods at the drum 1 side in the absence of the print drums 1 and 2 and air pumps 1' and 2'. In a table shown below the waveform, crosses show that items corresponding thereto are absent. This is also true with tables of FIGS. 5 through 13; circles show that items corresponding thereto are present. FIG. 4 shows positions where the load of the air pump 2' acts and positions where the load of the air pump 1' acts over a signal width corresponding to one period of the drum 1. Such positions also apply to the other waveforms. In FIG. 4, the loads of the 1' and 2' do not act at all.

Figure 5:
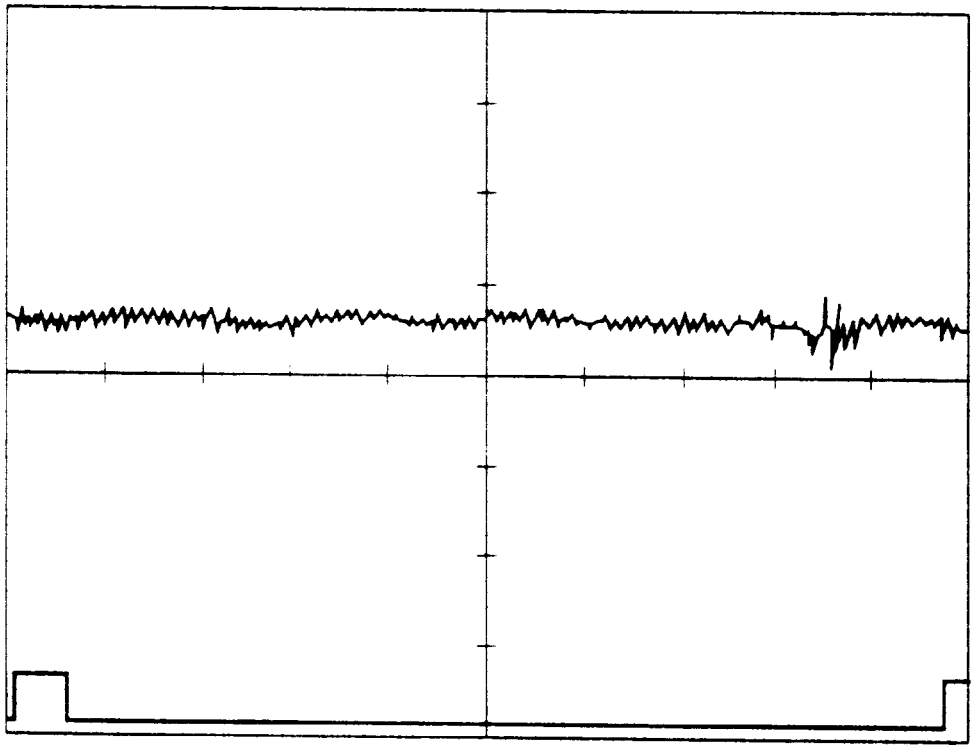
FIG. 5 shows a waveform representative of variation in the rotation speed of the upstream print drum occurred when an upstream air pump was present.

FIG. 5 shows a waveform appeared in the presence of the air pump 1'. It is to be noted that FIGS. 5 through 13 correspond to the left half of FIG. 4. It will be seen that the waveforms shown in FIGS. 4 and 5 differ little, i.e., the load of the air pump 1' effected the speed variation of the print drum 1 little. Although a waveform to be derived from the print drum 2 side in the presence of the air pump l' was not determined, the pump 1' presumably did not effect even the drum 2 side because it did not effect the drum 1 side.

Figure 6:
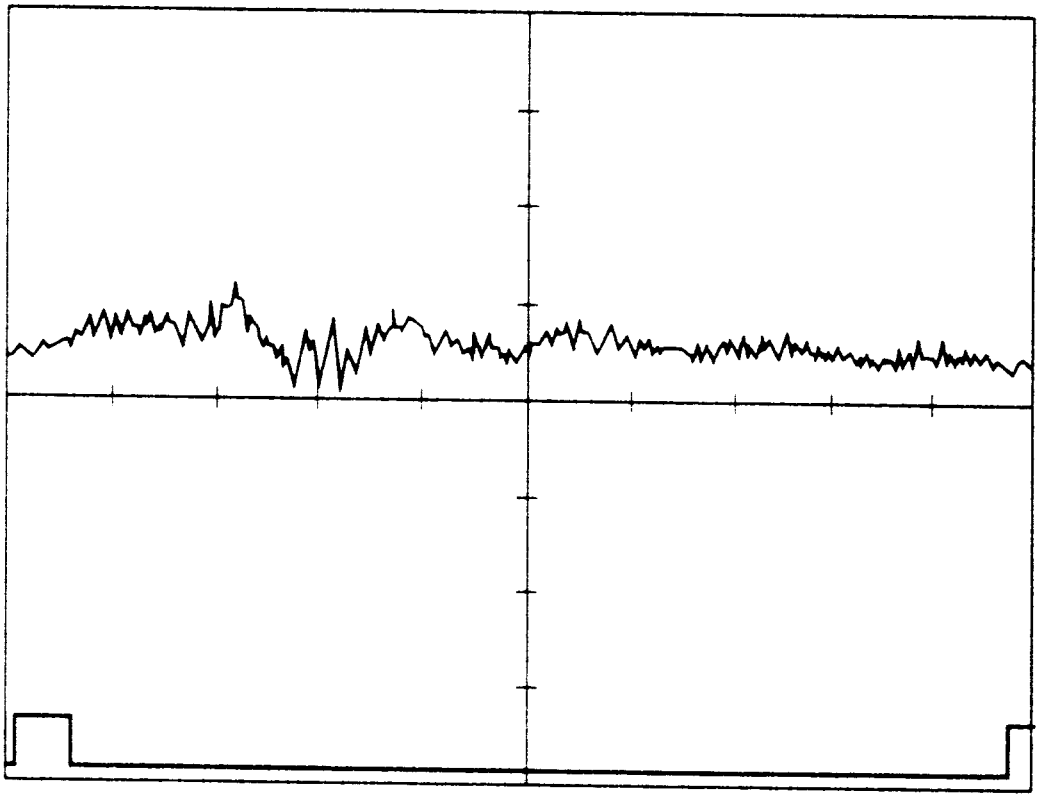
FIG. 6 shows a waveform representative of variation in the rotation speed of the upstream print drum occurred when a downstream air pump was present.
Figure 7:
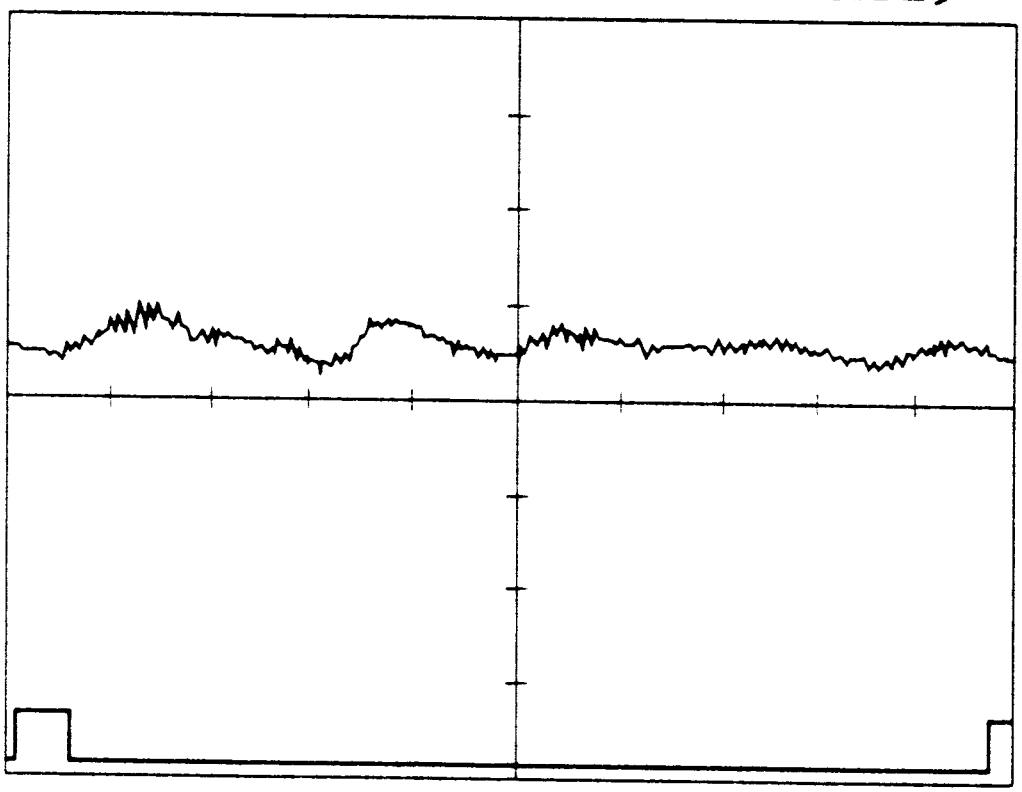
FIG. 7 shows a waveform representative of variation in the rotation speed of the upstream print drum occurred when a downstream print drum was present in addition to the downstream air pump.
Figure 8B:
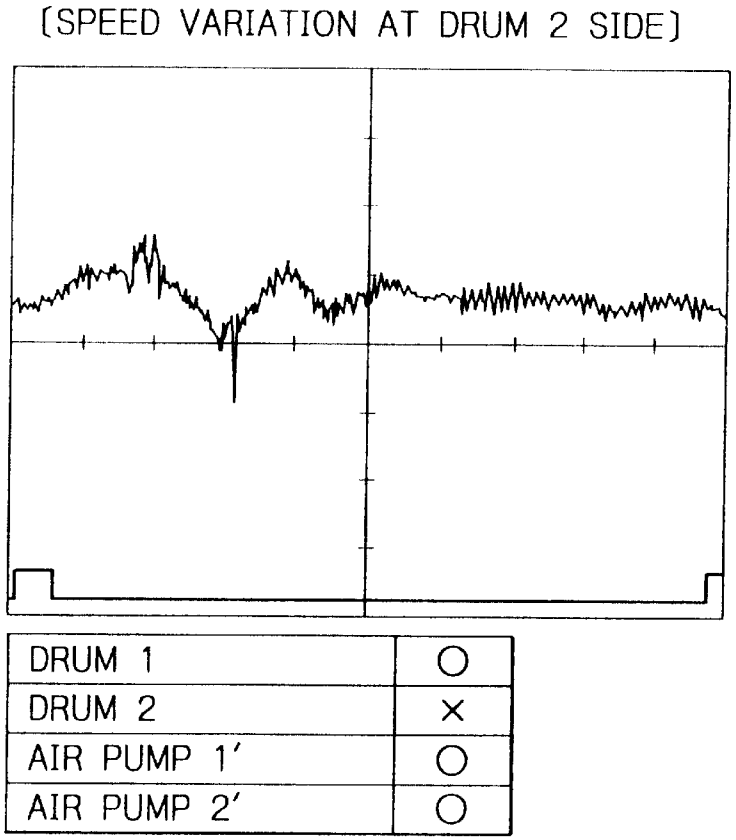
FIGS. 8A and 8B show waveforms representative of variation in the rotation speeds of the upstream print drum and downstream print drum, respectively, occurred when only the downstream print drum was absent.
Figure 8A:
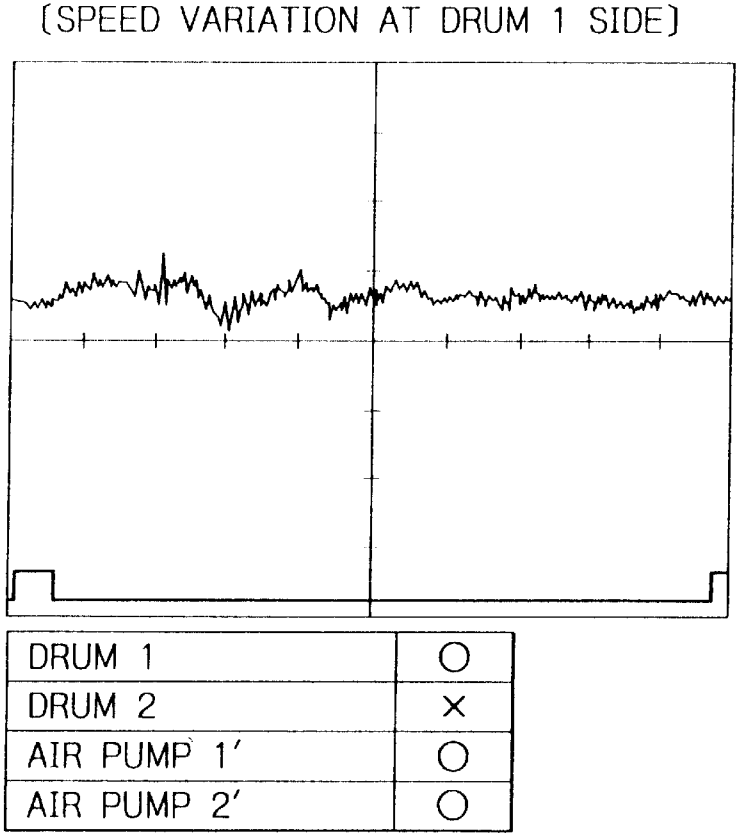

FIG. 6 shows a waveform representative of the speed variation of the print drum 1 and appeared when the air pump 1' of FIG. 5 was removed, and the air pump 2' was mounted instead. As shown, the load of the air pump 2' causes speed variation resembling waves to occur at the print drum 1 side. This is because a main motor generated a torque during the compression stroke of the air pump 2' and then overshot after the movement of the pump 2' over its top dead center. More specifically, the varying load (air pump 2') driven by the second color side or driven side noticeably aggravated the speed variation of the print drum 1 side.

Figure 9B:
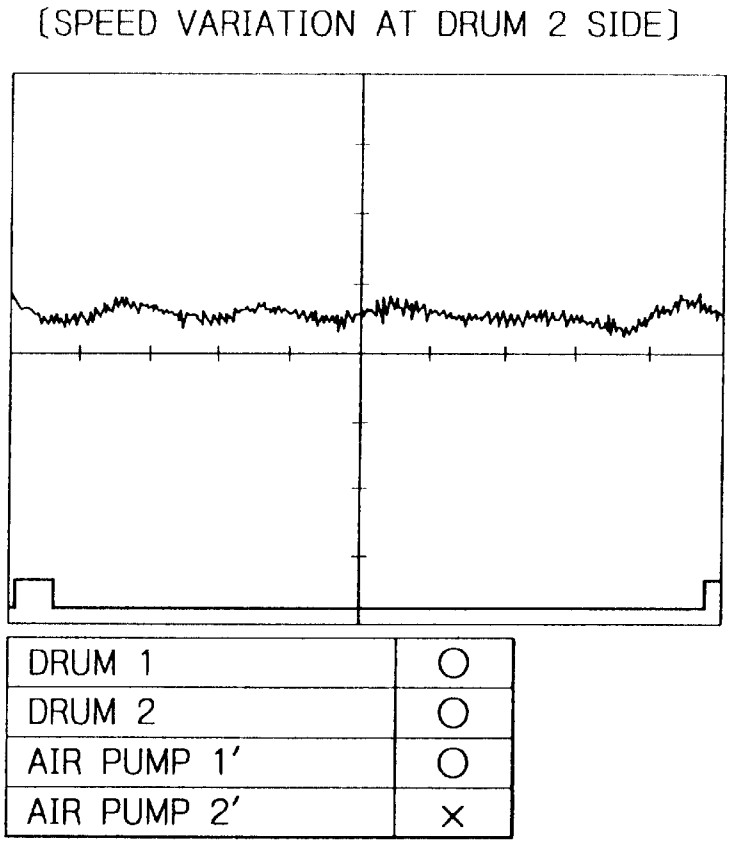
FIGS. 9A and 9B show waveforms representative of variation in the rotation speeds of the upstream print drum and downstream print drum, respectively, occurred when only the downstream air pump was absent.
Figure 9A:
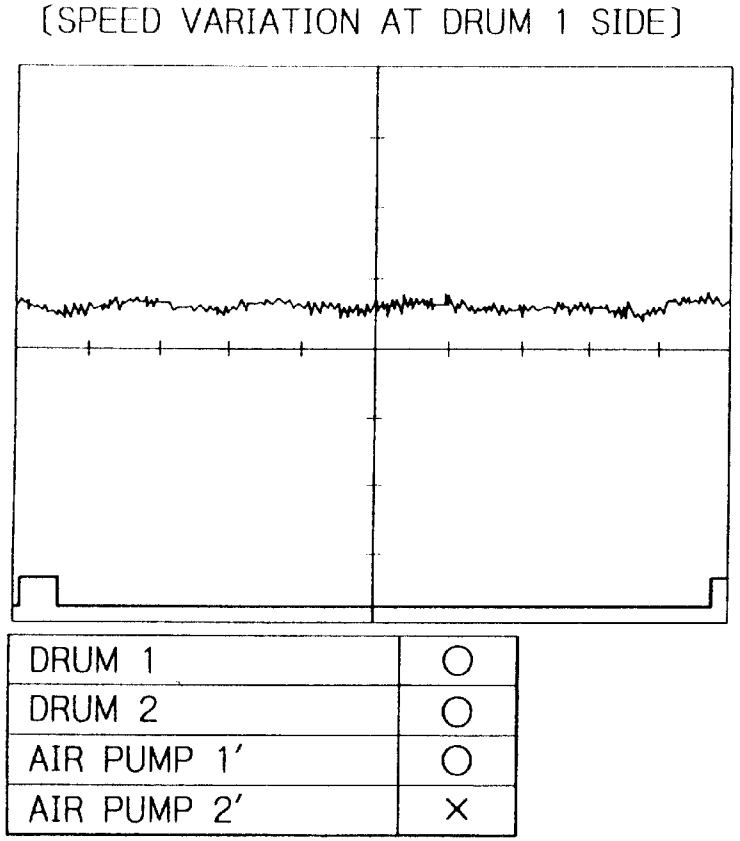
Figure 10B:
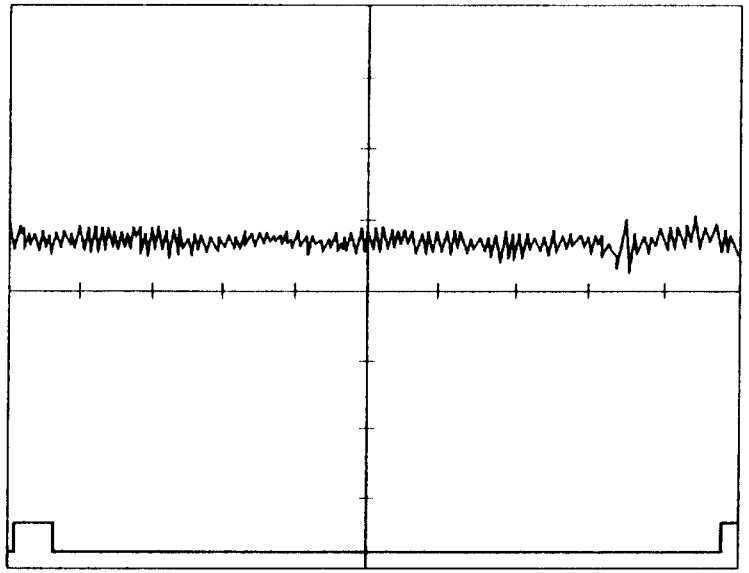
FIGS. 10A and 10B show waveforms representative of variation in the rotation speeds of the upstream print drum and downstream print drum, respectively, occurred when only the upstream and downstream air pumps were absent.
Figure 10A:
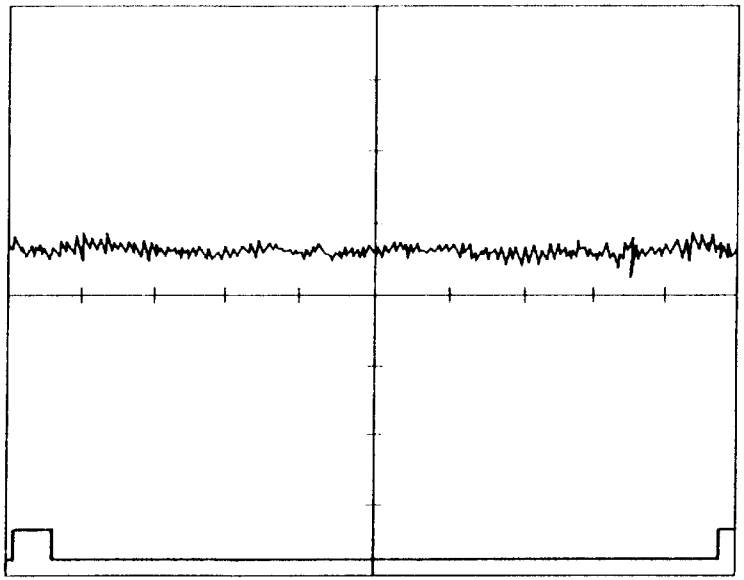
Figure 11B:
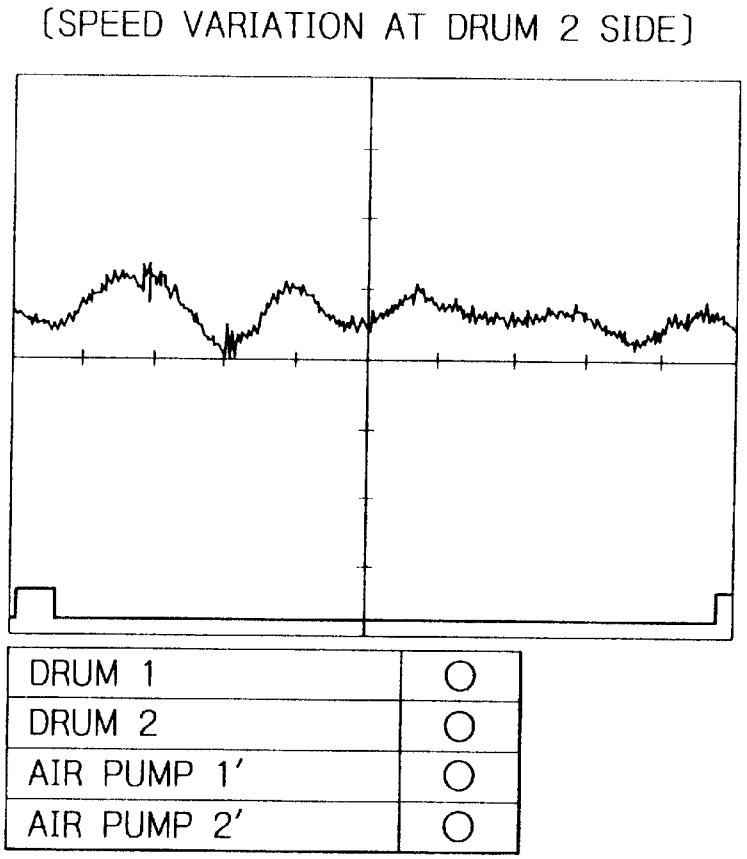
FIGS. 11A and 11B show waveforms representative of variation in the rotation speeds of the upstream print drum and downstream print drum, respectively, occurred when all of the print drums and air pumps were present.

FIGS. 7, 8A, 8B, 9A, 9B, 10A, 10B, 11A and 11B each show a particular waveform appeared when one or both of the print drums 1 and 2 were mounted. Waveforms shown in FIGS. 9B, 10B and 11B are representative of speed variation occurred at the print drum 2 side in the same conditions as in FIGS. 9A, 10A and 11B, respectively.

Figure 11A:
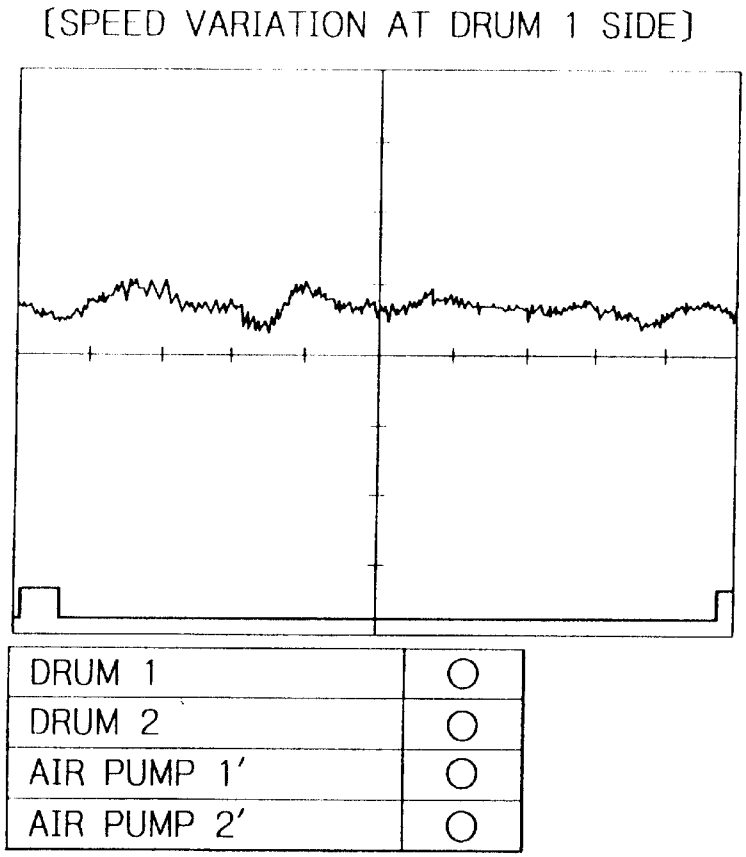

As FIGS. 11A and 11B indicate, when all of the print drums 1 and 2 and air pumps 1' and 2' were mounted, the speed at the print drum 2 side varied with greater amplitudes than the speed at the print drum 1 side. This is presumably because the timing belt absorbed and amplified the difference in speed between the print drums 1 and 2. On the other hand, as shown in FIGS. 9A and 9B, a noticeable difference in speed did not occur between the print drums 1 and 2 when the air pump 2' was absent.

Further, by comparing FIGS. 8A and 8B and FIGS. 11A and 11B, it will be seen that the presence of the print drum 2 having a great moment of inertia increases the difference in speed between the print drums 1 and 2. Combined waveforms of the print drums 1 and 2 are not shown in FIGS. 8A through 11B.

Figure 12:
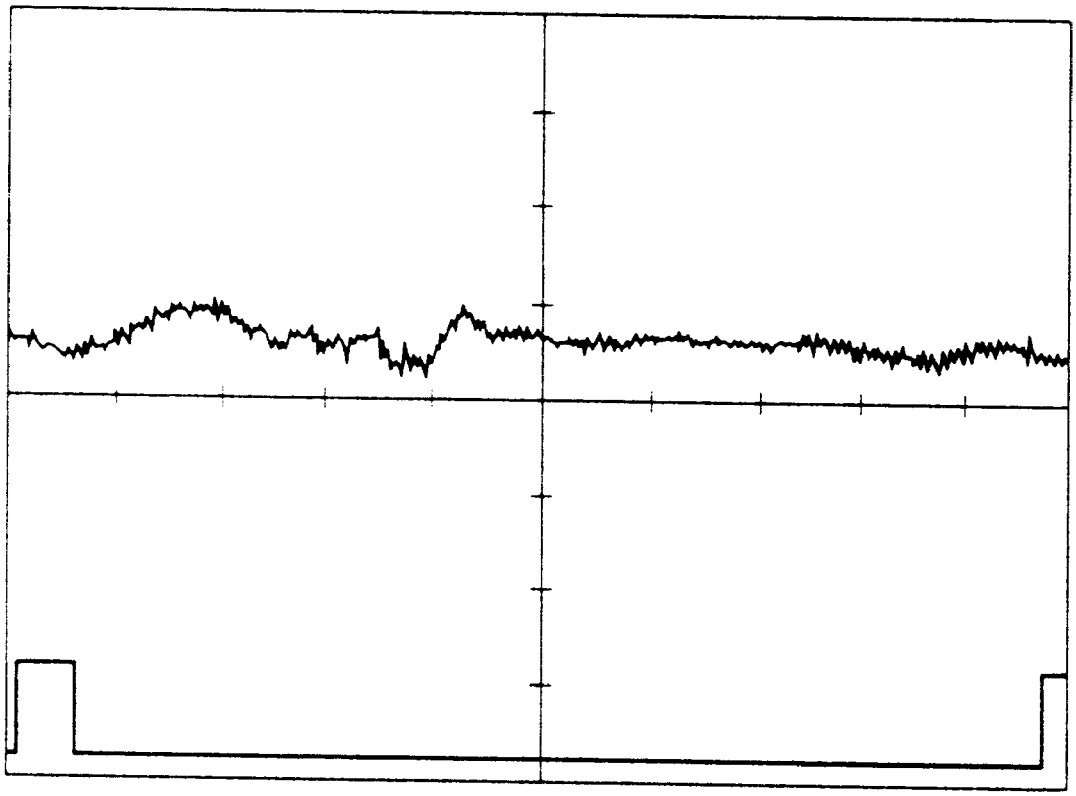
Fig. 12 PRIOR ART
FIG. 12 shows a waveform representative of variation in the rotation speed of the upstream print drum occurred when all of the print drums and air pumps were present in the conventional printer.
Figure 13:
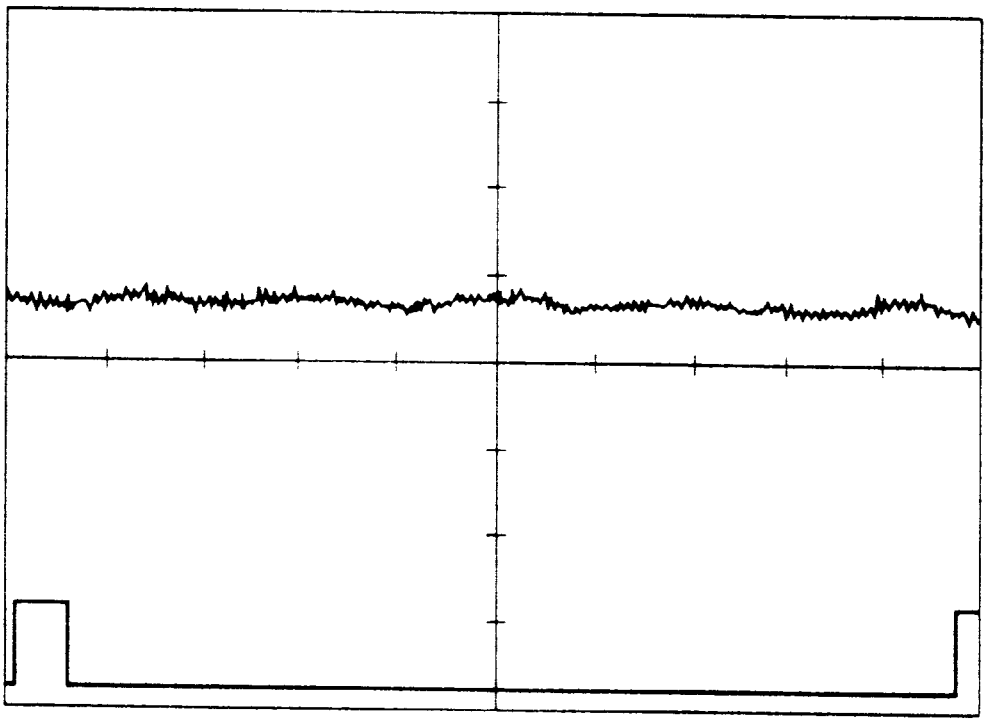
FIG. 13 shows a waveform representative of variation in the rotation speed of the upstream print drum occurred when all of the print drums and air pumps were present in the configuration shown in FIG. 2.

FIG. 12 shows a waveform representative of speed variation occurred at the print drum 1 side in the conventional printer in a 120 rpm free-run condition. FIG. 13 shows a waveform representative of speed variation occurred at the print drum 1 side in the configuration wherein the air pump 2' is driven by the print drum 1 side in a 120 rpm free-run condition. As FIGS. 12 and 13 indicate, the speed variation of the print drum 1 side decreased when the air pump 2' was driven by the print drum 1 side. The details of the above-described experiments suggest that the speed variation at the print drum 2 side also decreased, although not shown in FIGS. 12 and 13 specifically. It follows that by causing the driveline associated with the print drum 8, FIG. 2, to drive the air pump 86, it is possible to reduce synchronization errors between the print drums 8 and 10 in the timing belt type drive system and therefore offset ghosts.

While the illustrative embodiment has concentrated on the air pump 86, the present invention is similarly applicable to any other member whose load noticeably varies. For example, a sheet feed mechanism or a mechanism for the preliminary rotation of the press roller may be driven by the upstream (first color) driveline that is driven by the main drive source. This is also successful to reduce offset ghosts. In the case where the downstream print drum is driven by the main power source, such a member will be driven by the downstream driveline.

In summary, it will be seen that the present invention provides a printer capable of reducing synchronization errors between print drums ascribable to variation in load and therefore reducing offset ghosts while making the most of the advantages of a timing belt type drive system. This advantage is derived from a unique arrangement wherein a member causative of noticeable variation in load during printing is driven by a driveline assigned to a print drum that is connected to a main drive source.

Various modifications will become possible for those skilled in the art after receiving the teachings of the present disclosure without departing from the scope thereof.

What is claimed is:

1. In a printer including a plurality of print drums arranged at a preselected interval in a direction in which a paper sheet is conveyed, and a timing belt interlocking said plurality of print drums with respect to drive, a driveline assigned to one print drum and including a main drive source concentratedly drives a member causative of a noticeable variation in load during printing without regard to a positional relation between said member and said one print drum.

2. A printer as claimed in claim 1, wherein said member comprises an air pump for peeling the paper sheet from a respective print drum.

3. A printer as claimed in claim 1, wherein said one print drum is located at an upstream side in the direction in which the paper sheet is conveyed.

4. A printer as claimed in claim 3, wherein said member comprises an air pump for peeling the paper sheet from a respective print drum.

5. A printer comprising:

a main drive source;

a plurality of print drums arranged at a preselected interval in a direction in which a paper sheet is conveyed, and driven by said main drive source; and a timing belt interlocking said plurality of print drums with respect to drive;

wherein a driveline assigned to one print drum and including said main drive source concentratedly drives a member causative of a noticeable variation in load during printing without regard to a positional relation between said member and said one print drum.

6. A printer as claimed in claim 5, wherein said member comprises an air pump for peeling the paper sheet from a respective print drum.

7. A printer as claimed in claim 5, wherein said one print drum is located at an upstream side in the direction in which the paper sheet is conveyed.

8. A printer as claimed in claim 7, wherein said member comprises an air pump for peeling the paper sheet from a respective print drum.

* * * * *